US006484617B1

(12) United States Patent
Anderson et al.

(10) Patent No.: US 6,484,617 B1
(45) Date of Patent: Nov. 26, 2002

(54) ASSEMBLY AND PROCESS FOR CONTROLLED BURNING OF LANDMINE WITHOUT DETONATION

(75) Inventors: Richard C. Anderson, Logan, UT (US); Charles B. Zisette, Logan, UT (US); Robert D. Ciccarelli, King Of Prussia, PA (US); Richard B. Cragun, Pleasant View, UT (US); Michael G. Crilly, Hatboro, PA (US); John E. Delaney, Jr., Alexandria, VA (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 09/562,971

(22) Filed: May 3, 2000

Related U.S. Application Data

(60) Provisional application No. 60/133,403, filed on May 10, 1999.

(51) Int. Cl.[7] ..... F42B 33/06

(52) U.S. Cl. ..... 86/50; 102/293; 102/40; 89/1.13; 588/202

(58) Field of Search ..... 102/293, 402; 86/49, 50; 588/202, 203; 89/1.13

(56) References Cited

U.S. PATENT DOCUMENTS

| | | | |
|---|---|---|---|
| 2,433,875 | A | 1/1948 | Walker et al. |
| 2,771,841 | A | 11/1956 | De Fino |
| 3,090,306 | A | 5/1963 | Reuther |
| 3,109,369 | A | 11/1963 | Plumley |
| 3,112,669 | A | 12/1963 | Damblanc |
| 3,117,518 | A | 1/1964 | Porter et al. |
| 3,242,862 | A | 3/1966 | Stegbeck et al. |
| 3,638,569 | A | 2/1972 | Thomanek |
| 3,724,372 | A | 4/1973 | Phillips |
| 4,008,644 | A | 2/1977 | Kayser |

(List continued on next page.)

FOREIGN PATENT DOCUMENTS

| | | | |
|---|---|---|---|
| DE | 39 40 525 | C1 | 1/1991 |
| DE | 44 17 763 | A1 | 11/1995 |
| DE | 195 14 122 | A1 | 11/1995 |
| EP | 0 581 668 | A1 | 2/1993 |
| FR | 2 670 676 | | 6/1992 |
| GB | 2 335 971 | A | 10/1999 |

OTHER PUBLICATIONS

David Humphrey, A New anti–mine device developed in the West is being hailed as a breakthrough . . . "seeds of death". . . year, Western Daily Press, Nov. 1999.

A. Coghlan, "Burnt–out Case", New Scientist, Mar. 14, 1998, p. 10.

*Primary Examiner*—Harold J. Tudor

(57) ABSTRACT

An assembly and process designed to neutralize a landmine having a case loaded with an explosive charge set to detonate upon actuation. The assembly includes a housing provided with a chamber loaded with a solid propellant. One of the ends of the housing is exposed to permit the loaded propellant to communicate the chamber with the outside atmosphere. The propellant is remotely ignitable via a remotely operable igniter. The first end of said housing is constructed and arranged and the solid propellant is present in an amount and composition suitable for generating, upon ignition of the solid propellant, a plume sufficient in burn time and temperature both to penetrate through the case of the landmine positioned in spaced relation to the first end and to initiate controlled burning of the explosive charge of the landmine so that detonation of the explosive charge is either avoided or reduced due to pre-detonation partial consumption of the explosive charge by burning.

12 Claims, 3 Drawing Sheets

U.S. PATENT DOCUMENTS

| | | | | |
|---|---|---|---|---|
| 4,349,396 | A | 9/1982 | Mueller et al. | 149/19.3 |
| 4,432,816 | A | 2/1984 | Kennedy et al. | 149/19.3 |
| 4,601,761 | A | 7/1986 | Proctor et al. | |
| 4,773,298 | A | 9/1988 | Tischer et al. | |
| H865 | H | 1/1991 | Sery et al. | |
| 5,189,243 | A | 2/1993 | Hambric | |
| 5,249,500 | A | 10/1993 | Husseiny et al. | |
| 5,458,063 | A | 10/1995 | Laine et al. | |
| 5,524,524 | A | 6/1996 | Richards et al. | |
| 5,790,963 | A * | 8/1998 | Welham | 588/202 |
| 5,794,709 | A | 8/1998 | Clausen | |
| 5,844,160 | A | 12/1998 | Cieszkiewicz | |
| 5,932,835 | A | 8/1999 | Woodall et al. | |
| 5,936,184 | A | 8/1999 | Majerus et al. | |
| 5,939,663 | A | 8/1999 | Walters et al. | |
| 5,959,233 | A | 9/1999 | Garcia | |
| 5,979,290 | A | 11/1999 | Simeone | |
| 6,232,519 | B1 * | 5/2001 | Eidleman et al. | 588/202 |

* cited by examiner

ASSEMBLY AND PROCESS FOR CONTROLLED BURNING OF LANDMINE WITHOUT DETONATION

RELATED APPLICATIONS

Priority is claimed on U.S. Provisional Application No. 60/133,403 filed in the U.S. Patent & Trademark Office on May 10, 1999, the complete disclosure of which is incorporated herein by reference.

ORIGIN OF THE INVENTION

The U.S. Government has a paid-up license in this invention and the right in limited circumstances to require the patent owner to license others on reasonable terms as provided by the terms of N00 174-96-D-0020 awarded by Indian Head Division of the Naval Surface Warfare Center.

BACKGROUND OF THE INVENTION

1. Field of the Invention

This invention relates to an assembly and process for effecting demining operations, and in particular to an assembly and process for at least partially consuming the explosive within a landmine in a controlled and stable manner so that detonation of the explosive is avoided or reduced in magnitude.

2. Description of the Related Art

Since the development of landmines in World War I, landmines have found widespread military use as an effective deterrent to the advancement of enemy group troops during war time. For this purpose, anti-personnel landmines and anti-tank landmines are both known. Although the number of landmines currently actively used in the United States is negligible, landmines are quite abundant in many foreign countries. There are many currently active military conflicts for which landmines are being produced and planted. Additionally, in many parts of the world in which military conflicts have been resolved and landmines are no longer needed for military operations, the landmines nonetheless remain planted, active, and often forgotten. Oftentimes the landmines are not demined as the result of neglect or indifference over humanitarian concerns; sometimes a conscious decision is made not to demine based on factors such as the expense and hazards associated with demining operations.

It has been estimated that there are over 80 million active landmines scattered around the world in approximately 70 countries. Every month, these landmines are responsible for killing or maiming over 2000 people, most of whom are civilian casualties injured by the accidental triggering of landmines well after hostilities have ceased.

To date, humanitarian efforts to demine planted landmines in order to protect civilian interests have not been sufficiently effective. It has been estimated that for every land mine cleared, twenty are planted in its place. In 1994, approximately 100,000 landmines were demined, while an additional 2 million were planted. Moreover, there is a stockpile of landmines around the world that equals if not exceeds the number of active planted landmines.

One of the principle reasons, if not the principle reason, that the proliferation and planting of new land mines has outpaced current demining efforts is the relatively high cost and complexity of current demining devices. The high cost and complexity that characterizes current demining devices make the conventional devices impractical for use in third world countries, where landmines are most prevalent. Third world countries are often unable to both afford conventional demining devices and find or afford adequately skilled personnel for operating the complex conventional demining devices.

Another problem which characterizes conventional demining devices is that the conventional demining devices accomplish their demining objective by the detonation of active landmines. For example, vehicle-driven plowing apparatuses for clearing minefields and detonating landmines are disclosed in, by way of example, U.S. Pat. Nos. 4,773,298, 5,189,243, 5,794,709, and 5,844,160. Other devices, uch as that disclosed in U.S. Pat. No. 5,458,063, rely on the generation of a agnetic field to initiate and detonate a magnetic influenced mine. U.S. Pat. No. 4,008,644 discloses a vehicle-driven apparatus equipped with a plurality of rocket motor engines constructed and arranged to clear landmines and detonate the landmines with streams of high velocity gases exhausted from the rocket motor engines. It is also known to use C-4 to explode landmines. However, these devices operate by effecting the violent detonation of active landmines, which presents safety hazards, including the potential for collateral damage as well as scattering of debris that may further complicate location and neutralization of other landmines.

It has been proposed that the above-discussed problems could be addressed by using conventional road-side flares for effecting the controlled neutralization of landmines. Generally, road-side flares are characterized by their generation of mostly solid effluents and are available in high quantities and at low expense. However, road-side flares exhibit high variability in performance when tested on different types of landmines and landmine cases. As a consequence, the use of road-side flares in controlled demining operations has been limited.

SUMMARY OF THE INVENTION

It is, therefore, an object of this invention to satisfy a significant need in the art for a demining assembly that is sufficiently inexpensive and simple to operate to permit its widespread use in third world countries incapable of affording large quantities of conventional demining devices or lacking sophisticated and trained personnel to operate conventional demining devices, yet also permits for the safe and controlled neutralization of a wide variety of landmines by effecting the burning, instead of detonating, of the landmine explosive charge.

In accordance with the principles of this invention, these and other objects are satisfied by the provision of an assembly and process designed to neutralize a landmine by burning through the landmine case and subsequently initiating burning of the explosive charge within the case. The initiation of the explosive charge burning is conducted in a controlled manner so that detonation of the explosive charge commonly either is avoided by initiating the controlled burning of all of the explosive charge to leave the landmine case empty or is substantially reduced and less violent due to burning of a significant portion, but less than all, of the explosive charge prior to detonation.

According to one embodiment of the invention, the assembly comprises a housing (or case) defining a chamber and having opposite first and second ends, the first end being open to communicate the chamber with the atmosphere outside of the housing and the second end preferably being sealed. Loaded within the chamber is a solid propellant. The assembly further includes an igniter remotely operable, be it by electronic device, timing fuse, or other remotely operable igniter that permits ignition of the solid propellant from a safe distance. Optionally, the assembly may further include a stand for maintaining the solid propellant charge a fixed distance (or clearance) away from the landmine case.

The housing is designed, e.g., without a throat portion, and the solid propellant is present in an amount and possesses a suitable design and composition for generating, upon ignition of the solid propellant, a plume sufficient in burn time duration and temperature to penetrate through the case of the landmine positioned in spaced relation to the first end and initiate controlled burning of the explosive charge of the landmine. Once controlled burning of the explosive charge commences, the firing of the solid propellant may be terminated by consumption of the propellant or otherwise. The explosive charge of the landmine is self-deflagrating, meaning that the explosive charge will continue to burn, preferably without detonation, until completely consumed. However, complete consumption of the explosive charge via burning cannot always be assured, since heat build up within the landmine case can cause inadvertent detonation of the explosive charge in some cases. Thus, sometimes detonation of the explosive charge is reduced in degree, rather than completely avoided, due to the pre-detonation partial consumption of the explosive charge by burning. Preferably, the solid propellant is of the type suitable for use in rocket motors, such as reusable solid rocket motors and other solid rocket motors.

The low cost of suitable solid propellants, housings, and igniters of the assemblies make the demining assembly sufficiently inexpensive for widespread use in third world countries incapable of affording large quantities of conventional demining devices, thereby contributing to realization of one of the objects of this invention. Further, the wide availability of ignition devices that are easily operated with minimal instruction realizes the object of making the demining assembly sufficiently simple to permit its operation by users lacking the sophistication to operate more complex conventional demining devices. Furthermore, the object of providing a safe and controlled technique which does not place the safety of the operator in jeopardy is attained by both the provision of an ignition device that is capable of remote actuation and the selection of an appropriate solid propellant and assembly that are designed to initiate controlled burning of the explosive charge of the landmine. By having a sufficient portion or all of the explosive charge consumed in a controlled manner via burning, rather than detonating the explosive charge, the likelihood of collateral detonation of other landmines or injuries due to propelled shrapnel is significantly reduced or eliminated. Additionally, remaining burned remnants of the explosive are inert, and, therefore, do not require special handling or disposal procedures.

The landmine neutralization assembly of this invention can be practiced on a variety of different types of landmines, including plastic anti-personnel landmines, metal anti-armor landmines, small anti-personnel landmines, plastic or fiberglass antiarmor landmines, and wooden antipersonnel landmines, as well as sub-munitions and other ammunition.

These and other objects, aspects and advantages of the invention will be apparent to those skilled in the art upon reading the specification and appended claims which, when read in conjunction with the accompanying drawings, explain the principles of this invention.

BRIEF DESCRIPTION OF THE DRAWINGS

The principles of this invention are elucidated upon by the following drawings, in which.

DETAILED DESCRIPTION OF THE INVENTION

Figure 3:
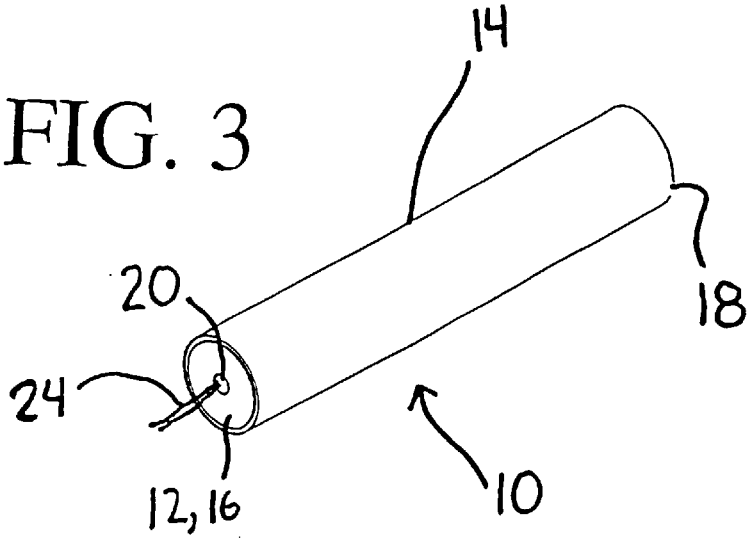
FIG. 3 is a perspective view of the assembly of FIG. 1 independent of its stand.
Figure 4:
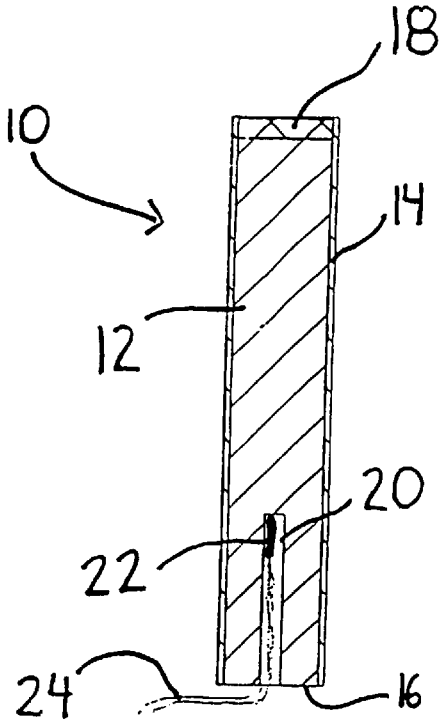
FIG. 4 is a side cross-sectional view of the assembly depicted in FIG. 3.
Figure 5:
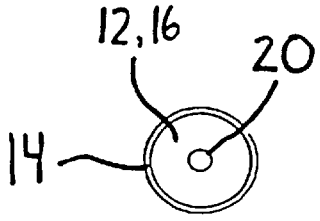
FIG. 5 is a bottom end view of the assembly depicted in FIGS. 3 and 4.

An assembly in accordance with one embodiment of this invention is illustrated in FIGS. 3–5 and generally designated by reference numeral 10.

The propellant assembly 10 includes a solid propellant 12 encased within a housing (or case) 14. The lower (or first) end 16 of the housing 14 is open to expose the solid propellant 12 to the outside environment, whereas the upper (or second) end 18 of the housing 14 is sealed.

The solid propellant 12 selected should be present in an amount and composition suitable for generating a plume sufficient in burn time and temperature both to penetrate through the case of the landmine positioned in spaced relation to the lower end 16 and to initiate controlled burning of the explosive charge of the landmine. Additionally, the solid propellant 12 preferably is non-explosive, meaning that its explosive rating is Class 1.3, or even lower (at Class 1.4) to reduce handling and shipping costs. Although in the illustrated embodiment the solid propellant 12 has a central perforation 20, it is understood that the solid propellant 12 can be end burning.

Generally, conventional rocket motor propellants that generate mostly gaseous effluent streams (as opposed to conventional road-side flares that generate mostly solid effluent streams), and preferably at least 60% by weight gaseous effluent streams, present excellent candidates for the propellant 12. Other candidates include decoy flare compositions, such as is disclosed in U.S. Pat. No. 5,834,680, the complete disclosure of which is incorporated herein by reference to the extent that it is consistent and compatible with this specification. Exemplary constituents of the solid propellant are discussed in greater detail below, although it should be understood that the following list of constituents is not meant to be exhaustive. The selection of constituents and constituent concentrations and amounts will be dependent upon the particular use for which assembly 10 is intended.

Representative polymeric bases for the solid propellant 12 include, by way of example, polybutadiene acrylonitrile acrylic-acid terpolymer (PBAN), hydroxy-terminated polybutadiene (HTPB), carboxy-terminated polybutadiene (CTPB), polyethylene oxide (PEG), glycidyl azide polymer (GAP), polyoxetanes, polypropylene oxide, polybutylene oxide, and polytetrahydrofuran.

Representative curing agents for the solid propellant 12 include, by way of example, the following: diisocyanates and polyisocyanates, such as isophorone diisocyanate (IPDI), dimeryl diisocyanate (DDI), hexamethylene diisocyanate (HMDI), M-tetramethylxylene diisocyanate (TMXDI), DESMOUR N-100 from Mobay Chemical; and epoxide curatives, which are especially suited for carboxy-terminated polymer.

Suitable fuels include the following: metals, such as aluminum, magnesium, zirconium, and boron; metal alloys, such as aluminum/magnesium alloys; metal hydrides, such as zirconium or titanium hydride; and so-called metalloids, such as silicon and borides.

Representative oxidizers include by way of example, the following: perchlorates, such as ammonium perchlorate, potassium perchlorate, lithium perchlorate; nitrates, such as ammonium nitrate; metal oxides and metal hydroxides; and other oxidizers and nitramines, such as TEX (4,10-dinitro-2,6,8,12-tetraoxa-4,10-diazatetracyclo $[5.5.0.0^{59}0.0^{3,11}]$ dodecane), RDX (trimethylene trinitramine), HMX, CL20 (2,4,6,8,10,12-hexanitro-2,4,6,8,10,12-hexaazatetracyclo $[5.5.0.0^{59}0.0^{3,11}]$dodecane), and combinations thereof.

Without being exhaustive, other additives that can be mentioned as suitable or desirable for the solid propellant include the following: bum rate catalysts, such as iron oxide; smoke-reduction additives such as zirconium carbide, carbon, and aluminum oxide; refractory oxides, such as $TiO_2$, $ZrO_2$, $A1_2O_3$, and $SiO_2$; processing aids such as octadecylisocyanate; plasticizers, such as DOA (dioctyladipate), TEGDN (triethyleneglycol dinitrate), DEGDN, (diethyleneglycol dinitrate), TMETN (trimethylolethane trinitrate), BTTN (butanetriol trinitrate). and BuNENA (n-butyl-2-nitratoethyl-nitramine); and cure catalysts, such as triphenyl bismuth, triphenyltin chloride, dibutyltin diacetate, and dibutyltin dilaurate.

The housing or case 14 is preferably made of a low cost material having sufficient structural strength to retain the solid propellant 12 during casting and burning. By way of example, the housing 14 can be a pulp product such as paper or cardboard, paper phenolic, metal or alloy, composite material, or plastic, such as nylon, or combination thereof. Depending upon the material selected for making the housing 14, it may be desirable to interpose a thermal liner (not shown) between the housing 14 and the solid propellant 12. Preparation of such thermal liners is well known in the art and generally described in U.S. Pat. No. 5,767,221, the disclosure of which is incorporated herein by reference to the extent that it is consistent and compatible with this specification.

The upper end 18 of the housing 14 is sealed with a suitable sealant, such as, by way of example, one or more epoxy resins and/or urethane adhesives, such as KALEX urethane (D50), available from Hardman Division of Harcros Chemicals Inc.

Absent from the lower end 16 of the housing 14 is a nozzle throat capable of creating internal pressure and thrust of sufficient velocity to detonate the landmines. In this manner, the plume created by the assembly 10 serves to melt the landmine case and initiate burning the landmine explosive, rather than impinging on the landmine with sufficient force to dislodge and/or detonate the landmine (which is the object of U.S. Pat. No. 4,008,644) or make the assembly 10 propulsive.

The initiator 22 is positioned in operative communication with the central perforation 20 of the solid propellant 12. Preferably, the initiator 22 is remotely operable. Suitable initiators 22 include electric matches with lead line (24) or standard fuse cords of sufficient length to allow the operator to move away from the assembly 10 by a sufficient distance prior to initiation so as to avoid injury in the event of an accidental detonation of the landmine explosive.

Although the breadth of this invention is not thereby limited, the landmine neutralizing assembly of this invention can have the following representative dimensions: height of the housing 14: 12.7 cm (5 inches); the diameter of the housing 14: 2.37 cm (0.932 inch); the height of the seal at the second end 18 of the housing: 0.51 cm (0.2 inch); the height ofthe central perforation 20: 3.8 cm (1.5 inches); and the diameter of the central perforation 20: 0.477 cm (0.188 inch). This assembly will produce a burn time of approximately 70 seconds.

Figure 1:
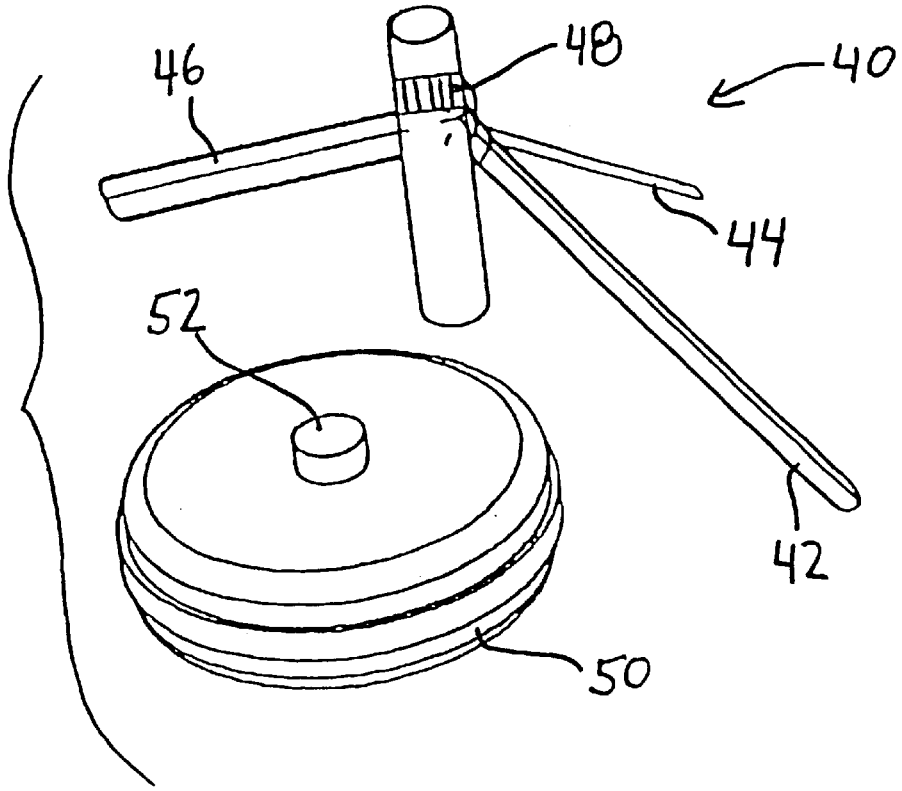
FIG. 1 is an elevated perspective view of an assembly according to an embodiment of this invention mounted on a stand in operative relationship with a landmine.
Figure 2:
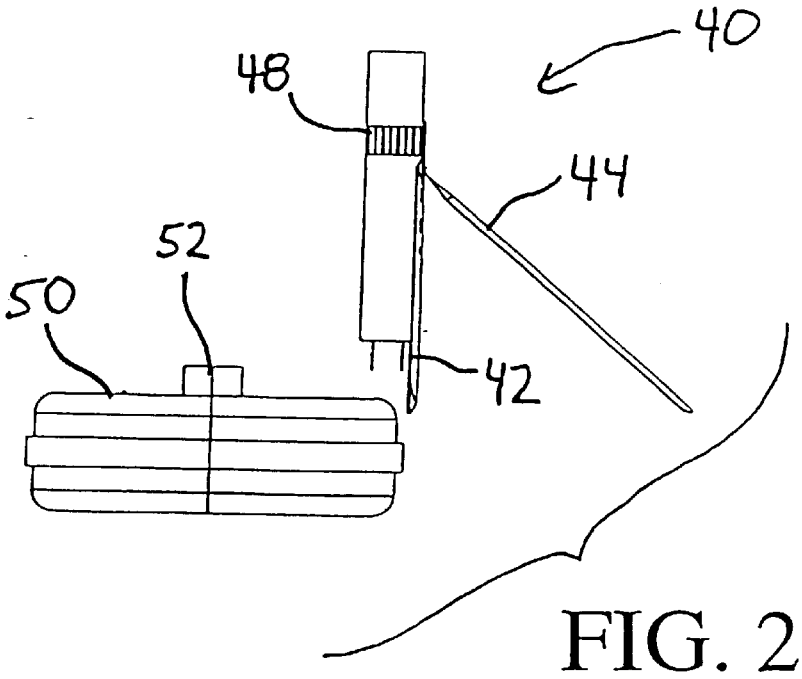
FIG. 2 is a side view of the illustration of FIG. 1.

Referring to FIGS. 1 and 2, the assembly 10 is depicted as being mounted on a stand, which is generally designated by reference numeral 40, in fixed relation to a landmine 50. In the illustrated embodiment, the stand 40 is a tripod comprising three legs 42, 44, and 46 operatively connected with a hose clamp 48. Although a hose clamp 48 is shown as the connector, other fasteners, such as tape, can be used for securing the legs together and for mounting the assembly 10. Additionally, it is to be understood that the stand can include more than three legs or other types of support structures. The legs 42, 44, and 46 can be, and preferably are, flexible or adjustable to permit adjustments to the clearance between the assembly 10 and the landmine 50. More preferably, the legs 42, 44, and 46 are adjustable in length independent of one another so as to permit stable mounting of the assembly on inclined or uneven surfaces.

Figure 6B:
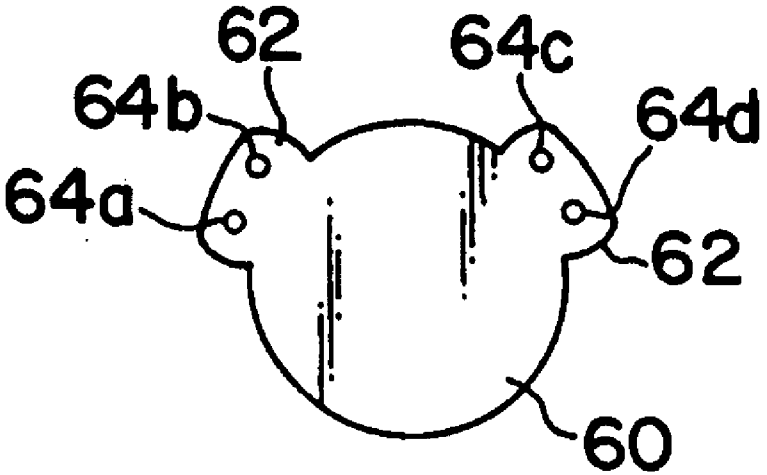
FIGS. 6A and 6B are respectively perspective and top plan views of an upper end cap fitting according to another embodiment of this invention.
Figure 6A:
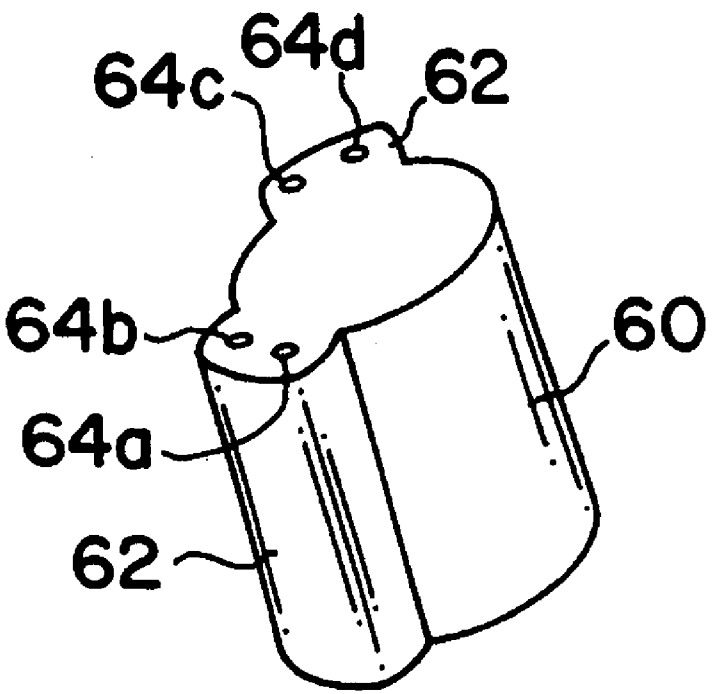

The illustrated tripod stand can be replaced with other devices and apparatuses for holding the landmine-neutralizing assembly 10. For example, as shown in FIGS. 6A and 6B, the illustrated hose clamp 48 can optionally be replaced by an upper end cap fitting 60. The end cap fitting 60 has an inner peripheral surface that is approximately the same diameter as the outer diameter of housing 14, so that the upper end cap fitting 60 is securely and tightly fitted over the upper end 18 of the housing 14 in use. The upper end cap fitting 60 has radially flanged portions 62 with apertures (or bores) 64*a*, 64*b*, 64*c*, and 64*d* formed therethrough. The apertures 64*a*–64*d* function to receive support wires (not shown) or the like. For example, a first piece of wire can extend from the ground up through the upper end cap fitting 60 so as to pass through the first aperture 64*a*. The wire can be configured substantially as an inverted "U" (or horseshoe shape), so that the wire passes downward through the second aperture 64b and extends back to the ground. A second wire can be used in a similar manner and passed through third and fourth apertures 64*c* and 64*d*, so that the wires collectively form a pod or stand having four legs. Of course, more radially flanged portions and apertures can be provided around the circumference of the end cap fitting 60 to receive additional wires and increase the stability of the stand still further. In addition to the structural stability provided by this upper end cap fitting, another advantage of this particular embodiment is that the adhesive sealant provided at the upper end 18 becomes redundant in function to the end cap fitting, and therefore can be excluded from the assembly 10 to further reduce costs.

Another optional feature of this invention is a lower end cap fitting (not shown) for covering the lower end 16 of the housing 14. The lower end cap fitting serves to protect the solid propellant 12 during transportation and handling. Also, in a modified embodiment the lower end cap fitting includes an axially extending, concentrically positioned pin (or protrusion) for generating the center perforation 20 in the solid propellant. More specifically, placing the lower end cap fitting onto the lower end of the housing 14 loaded with propellant 12 prior to cure will cause the pin/protrusion to displace the propellant 12 within the housing 14, thus forming the center perforation. (The housing 14 can contain, near the lower end 16, a void unfilled with the solid propellant 12, so that the uncured solid propellant 12 may be displaced into the void during formation of the center perforation 20.) Alternatively, during manufacture the lower end cap fitting with pin/protrusion can be fitted onto the lower end 16 of the housing 16 prior to loading the housing with the propellant 12. In this manner, the propellant 12 is cast around the pin to form the center perforation 20 during manufacture. The lower end fitting can be retained on the housing 14 after cure until the landmine-neutralizing assembly 10 is used.

In operation, landmines can be safely and controllably neutralized (i.e., disabled) by arranging the assembly 10 a suitable distance from the landmine 50. Although the degree of clearance between the assembly 10 and the landmine 50 will often depend on the type of landmine being neutralized, generally a distance of from 0.64 cm (0.25 inch) to 1.27 cm (0.5 inch) is suitable. For example, the assembly 10 can be mounted on a disposable stand, such as the one illustrated in FIGS. 1 and 2 or, in the alternative, can be placed on the ground so that its open end faces the landmine. The solid propellant 12 is ignited with initiator 22 to create a plume, which is preferably directed at landmine case to impinge the case at approximately a right angle (i.e., normal to) for a sufficient amount of time to penetrate through the case of the landmine 50. As shown in FIGS. I and 2, the assembly 10 is preferably positioned so that its plume is offset relative to the detonator 52 of the landmine 50. The solid propellant 12 continues to burn for a sufficient amount of time and at an adequate temperature to initiate controlled burning of the explosive charge of the landmine 50. The lower end 16 of the housing 14 is provided without a nozzle throat that would otherwise build up internal pressure and generate thrust of sufficient velocity and force to either detonate the landmines or cause the assembly to become propulsive.

The foregoing detailed description of the invention has been provided for the purpose of explaining the principles of the invention and its practical application, thereby enabling others skilled in the art to understand the invention for various embodiments and with various modifications as are suited to the particular use contemplated. The foregoing detailed description is not intended to be exhaustive or to limit the invention to the precise embodiments disclosed. Modifications and equivalents will be apparent to practitioners skilled in this art and are encompassed within the spirit and scope of the appended claims.

We claim:

1. An assembly designed to neutralize a landmine having a case loaded with an explosive charge set to detonate upon actuation, said assembly comprising:

a solid propellant formulated for generating a mostly gaseous effluent stream, the solid propellant having a central perforation;

a housing provided with a chamber in which the solid propellant is loaded, the housing having opposite ends, at least a first of said ends being open to communicate said chamber with atmosphere outside of said housing and being free of a nozzle throat; and an igniter remotely operable to ignite said solid propellant, wherein said central perforation of said solid propellant is positioned and said first end of said housing is free of the nozzle throat for generating, upon ignition of said solid propellant, a plume sufficient in bum time and temperature to penetrate through the case of the landmine positioned in spaced relation to said first end and to initiate controlled burning of the explosive charge of the landmine so that detonation of the explosive charge is either avoided or reduced due to at least partial consumption of the explosive charge by burning prior to detonation.

2. The assembly of claim 1, further comprising a support structure constructed and arranged to support said housing in spaced relation to the case of the landmine.

3. The assembly of claim 2, wherein said support structure has at least three legs.

4. The assembly of claim 1, wherein a ratio of the height of said solid propellant to the height of said central perforation is about 3:1.

5. The assembly of claim 4, wherein a height to diameter ratio of said housing is about 5:1.

6. The assembly of claim 1, wherein said solid propellant comprises a solid rocket motor propellant.

7. A process for neutralizing a landmine having a case loaded with an explosive charge set to detonate upon actuation, said process comprising:

providing an assembly comprising:

a solid propellant formulated for generating a mostly gaseous effluent stream, the solid propellant having a central perforation;

a housing provided with a chamber and having opposite ends, at least a first of the ends being open to communicate the chamber with an atmosphere outside of the housing and free of a nozzle throat; and an igniter remotely operable to initiate burning of said solid propellant;

placing the first end of the housing in spaced relation to the case of the landmine;

igniting the solid propellant to create a plume and directing the plume towards the case of the landmine for a sufficient amount of time to penetrate through the case of the landmine positioned in spaced relation to the first end; and initiating controlled burning of the explosive charge of the landmine with the plume so that detonation of the explosive charge is avoided or reduced due to at least partial consumption of the explosive charge by said controlled burning.

8. The process of claim 7, wherein said placing comprises mounting the assembly onto a support structure.

9. The process of claim 8, wherein the support structure has at least three legs.

10. The process of claim 8, wherein a ratio of the height of said solid propellant to the height of said central perforation is about 3:1.

11. The process of claim 10, wherein a height to diameter ratio of said housing is about 5:1.

12. The process of claim 7, wherein the solid propellant is a solid rocket motor propellant.

* * * * *

UNITED STATES PATENT AND TRADEMARK OFFICE

CERTIFICATE OF CORRECTION

PATENT NO. : 6,484,617 B1 
DATED : November 26, 2002
INVENTOR(S) : Richard C. Anderson et al.

It is certified that error appears in the above-identified patent and that said Letters Patent is hereby corrected as shown below:

Column 8,
Line 2, change “bum” to -- burn --.

Signed and Sealed this

Eighteenth Day of March, 2003

JAMES E. ROGAN
*Director of the United States Patent and Trademark Office*